United States Patent [19]

Grunder

[11] 4,271,565

[45] Jun. 9, 1981

[54] METHOD AND APPARATUS FOR REGULATING OUT VARIATIONS IN THE SLIVER WEIGHT ON DEVICES FOR PROCESSING FIBRE SLIVERS

[75] Inventor: Werner Grunder, Mönchaltorf, Switzerland

[73] Assignee: Zellweger Uster, Ltd., Uster, Switzerland

[21] Appl. No.: 33,447

[22] Filed: Apr. 26, 1979

[30] Foreign Application Priority Data

Apr. 26, 1978 [CH] Switzerland ..... 4497/78

[51] Int. Cl.[3] ..... D01H 5/38

[52] U.S. Cl. ..... 19/240; 19/105; 19/106 R

[58] Field of Search ..... 19/12, 0.23, 0.24, 0.25, 19/98, 105, 106 R, 239, 240, 241; 222/55

[56] References Cited

U.S. PATENT DOCUMENTS

| | | | |
|---|---|---|---|
| 3,092,875 | 6/1963 | McLean | 19/0.23 |
| 4,137,487 | 1/1979 | Niestroj et al. | 19/240 |
| 4,161,052 | 7/1979 | Erben | 19/105 X |

*Primary Examiner*—Louis Rimrodt

*Attorney, Agent, or Firm*—Craig and Antonelli

[57] ABSTRACT

A method of and apparatus for regulating out variations in the sliver weight on processing machines such as cards, carding engines, draw frames and the like wherein a first measuring device measures either the absolute cross-section or the relative variations of cross-section relative to a predetermined fixed desired value of a fibre sliver issuing from the machine. The first measuring device forms a corresponding first test signal. An additional measuring device is arranged at a point upstream of the first measuring device with respect to the direction of travel of the fibre material. The additional measuring device produces a second test signal corresponding to the relative variations in the cross-section of the fibre material relative to an average value for these variations formed over a predetermined period. The first and second test signals are used for controlling at least one regulating device which controls the cross-section of the fibre sliver.

40 Claims, 3 Drawing Figures

METHOD AND APPARATUS FOR REGULATING OUT VARIATIONS IN THE SLIVER WEIGHT ON DEVICES FOR PROCESSING FIBRE SLIVERS

CROSS-REFERENCE TO RELATED APPLICATION

The present application is related to application Ser. No. 33,448 entitled "DEVICE FOR OBTAINING A CONTROL SIGNAL CORRESPONDING TO THE DENSITY OF A FIBRE WEB LYING ON A FIBRE-CARRYING ELEMENT OF A CARD," filed on Apr. 26, 1979 by Werner Grunder and Ernst Loch, which discloses a measurement device which can be used in conjunction with the present invention disclosed herein.

BACKGROUND OF THE INVENTION

This invention relates to the regulation of variations in the sliver weight on cards, carding engines, draw frames and the like.

There is a need in the processing of textile fibres to be able to compensate for unavoidable irregularities in intermediate products by means of correcting devices. Such irregularities can be produced by properties of the material, properties of the machinery, by the personnel or by chance. In the final analysis, the better the intermediate products the better the finished products and the finished products can either be reduced to a better price or can produce less waste or scrap and thus save costs.

For economic reasons, stages of manufacture with a maximum yield, i.e. with a large amount of processed fibre per unit time are particularly suitable for the use of correcting devices. The card and the draw frame provide optimum properties for cotton spinning mills. Various measuring and regulating devices for card and draw frame slivers are also already known. A measuring device is usually provided at the machine outlet to continuously measure the fibre sliver delivered with respect to its cross-section and to produce a signal by means of which the amount of fibre supplied can be controlled by means of a regulating device in such a way that a weight of sliver which is as constant as possible per unit length (i.e. a sliver count which is as constant as possible) is delivered.

The apparatus which has been conventional up until now has a closed control circuit. However, owing to the relatively long path of the fibre between the regulating position and measuring position, such known apparatus has a dead time which makes it impossible in principle to regulate out errors which are shorter than the path of the fibre between the regulating position and measuring position. On the card with measurements on the take-off calenders and regulation of the speed of the feed roller, this path of the fibre corresponds to about 4 meters sliver length. In subsequent processing, the card slivers are, however, drafted by 100-fold to 1000-fold so that errors of at least 400 to 4000 meters length are still contained in the finished yarn in spite of regulating apparatus. Any significant reduction in these residual errors, therefore, denotes a technical progress toward improvement in the quality of the textile end product.

The draw frame which usually follows a card has until now also been subjected to similar restrictions with regard to regulation in the closed control circuit. Although in this case the distance between regulating position and measuring position is smaller, it is still sufficiently large for considerable dead times to exist, and thus residual errors remain in the sliver. Since virtually none of the subsequent processing operations allows regulating out, the residual errors also act, in the final analysis, as quality-impairing count variations in the finished product.

Some proposals for improvement are known, in particular for reducing the correction length on cards, carding engines and draw frames. However, these known proposals are burdened with considerable disadvantages. For example, the following measures have been considered on cards and found disadvantageous:

(a) various means of regulating the drafting mechanism, and the drawing of the drafting mechanism at the outlet of the card being modified in opposition to the variations in the cross-section of the sliver. Disadvantages of this measure are that it is mechanically complicated and expensive, particularly in the case of subsequent regulator modification;

(b) regulation of the drawing between the doffer and take-off calender is disadvantageous in that it involves considerable interventions into the card, has a small control region, is unflexible, and results in difficult servicing;

(c) measuring the weight of the fibre material introduced at the card inlet in the open control circuit. This approach is disadvantageous because the measuring member is complicated and imprecise owing to a poor opening with regard to short deviations, and has high sensitivity to differences in the opening of the flocks in the feed sliver.

In draw frames, one method of reducing the correction length which has been considered is the measurement of the entering fibre slivers and evaluation in an open control circuit. In the present state of the art, this measurement can be made virtually only with a mechanical measuring member or an isotopic measuring member. Disadvantages of this method are that an isotopic measuring member encounters pyschological resistance and demands additional safety measures. With a mechanical measuring member, the marked compression of the entering slivers is disadvantageous in regard to the subsequent drafting. In addition, an open control circuit demands very precise conformity between the characteristic of the measuring member and regulating member, which is virtually unobtainable for long and large deviations from the desired value of the feed sliver.

SUMMARY OF THE INVENTION

An object of the present invention is to permit the correction length to be reduced, while avoiding these disadvantages.

To achieve this and other objects according to the present invention, there is provided a method of regulating out variations in the sliver weight on cards, carding engines, draw frames and the like with a first measuring device for measuring the absolute cross-section or the relative variations of cross-section relative to a predetermined fixed desired value of the fibre sliver issuing from the machine outlet and for forming a corresponding test signal, wherein an additional measuring device is arranged at a point upstream of the first measuring device with respect to the direction of travel of the fibre material, and produces a second test signal corresponding to the relative variations in the cross-section of the fibre material with respect to an average value for these variations formed over a limited period, the first and second test signals being used for controlling at least one regulating device controlling the cross-section of the fibre sliver.

The present invention also provides a device for carrying out this method which comprises a first measuring device for measuring the absolute cross-section or the relative variations in cross-section relative to a predetermined fixed desired value of the fibre sliver issuing at a machine outlet and for forming a corresponding first test signal, a second measuring device which is arranged upstream of the said first measuring device with respect to the direction of travel of the fibre material, which second measuring device is arranged to provide a second test signal reproducing the relative variations in the cross-section of the fibre material relative to an average value of these variations formed over a limited period, and regulating devices for controlling the cross-section of the fibre sliver by means of the first and second test signals.

DETAILED DESCRIPTION OF THE INVENTION

Figure 1:
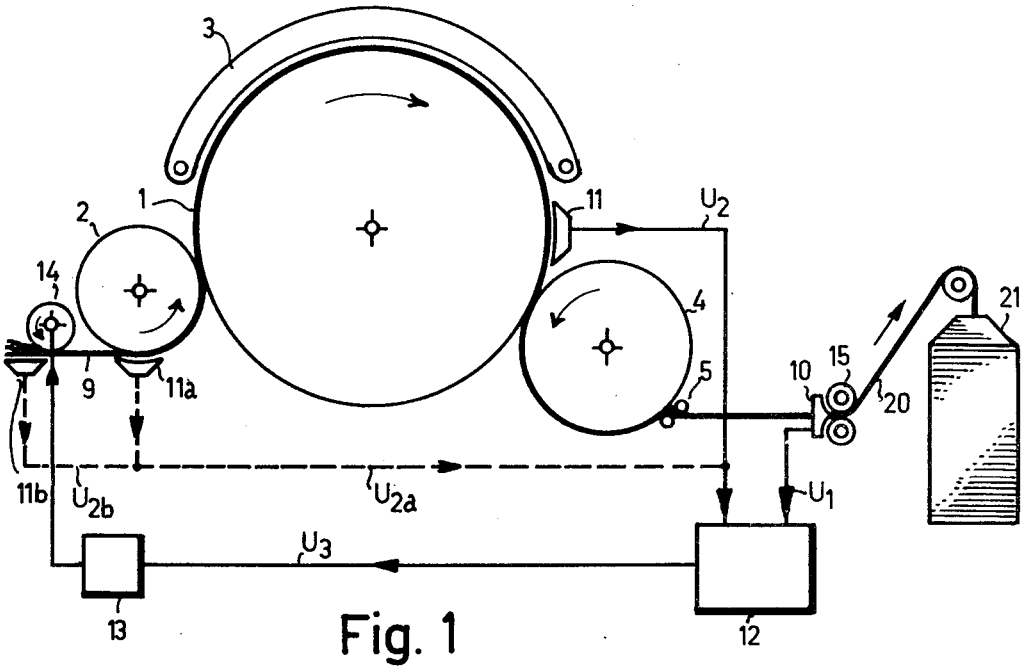
FIG. 1 illustrates a card with a first type of regulator in accordance with the present invention.

The card of known design shown in FIG. 1 consists of a cylinder 1, a licker-in 2, flats 3, doffer 4, a pair of take-off rollers 5 and take-off calenders 15. The supplied fibre material 9 is metered in by means of a feed roller 14 and disperses as a fibre coating over the covering of the cylinder. A web is taken from the cylinder by the doffer 4, is removed from the doffer 4 by the take-off rollers 5 and is combined to form a card sliver 20 in a funnel which can advantageously be designed in a known manner as a first measuring device 10. It is then taken off by the take-off calender 15. Thereafter, it passes into a fibre sliver take-up device 21.

The first measuring device 10 transmits a first test signal $U_1$ to a signal evaluator 12 and an additional test signal $U_2$ is also fed to this signal evaluator 12 by another measuring device 11*a* which can also be constructed in a known manner. The first test signal $U_1$ corresponds to the absolute value or the variations about a fixed predetermined desired value of the cross-section of the fibre sliver, while the additional test signal $U_2$ contains only the relative variations in the fibre coating located on the cylinder, relative to an average value of these variations formed over a limited period. Since the licker-in 2 and the cylinder 1 rotate at higher speed, $U_2$ has a dead time of only a few hundredths of a second with respect to the amount of fibre fed by the feed roller 14.

Numeral 11*a* denotes an alternative arrangement of the second measuring member, namely in the region of the licker-in 2. In this case, the corresponding test signal $U_{2a}$ is fed to the signal evaluator 12 instead of the signal $U_2$. This arrangement has the advantage that the measuring position for the second test signal $U_{2a}$ determines the amount of fibre material more precisely on the feed roller 14. However, it can only be produced if it is possible to fit the measuring device 11*a* at this position.

Another variation of the arrangement of the measuring device is denoted by numeral 11*b*, which is also shown in FIG. 1. This arrangement has the advantage that a test signal $U_{2b}$ can be determined before the amount of fibre supplied has passed the feed roller 14.

The first test signal $U_1$ and the second test signal $U_2$ (or $U_{2a}$ or $U_{2b}$) are superimposed on each other in the signal evaluating device 12 in such a way that a resulting combined signal $U_3$ or $U_4$ (FIG. 2) containing portions of both signal magnitudes is formed. In a first design according to FIG. 1, the combined signal $U_3$ enters a regulating member 13, preferably a regulatable direct current motor which drives the feed roller 14 or a controllable gear mechanism driven by the doffer 4 which drives the feed roller 14. Thus, the speed of the feed roller 14 is controlled according to the magnitude of the combined signal $U_3$. The amount of fibre material 9 submitted to the card is metered in such a way that a regulated fibre coating is deposited on the covering of the cylinder 1 and is then taken by the doffer 4 and the take-off rollers 5 as a uniform fibre web and combined to form the sliver 20.

Figure 2:
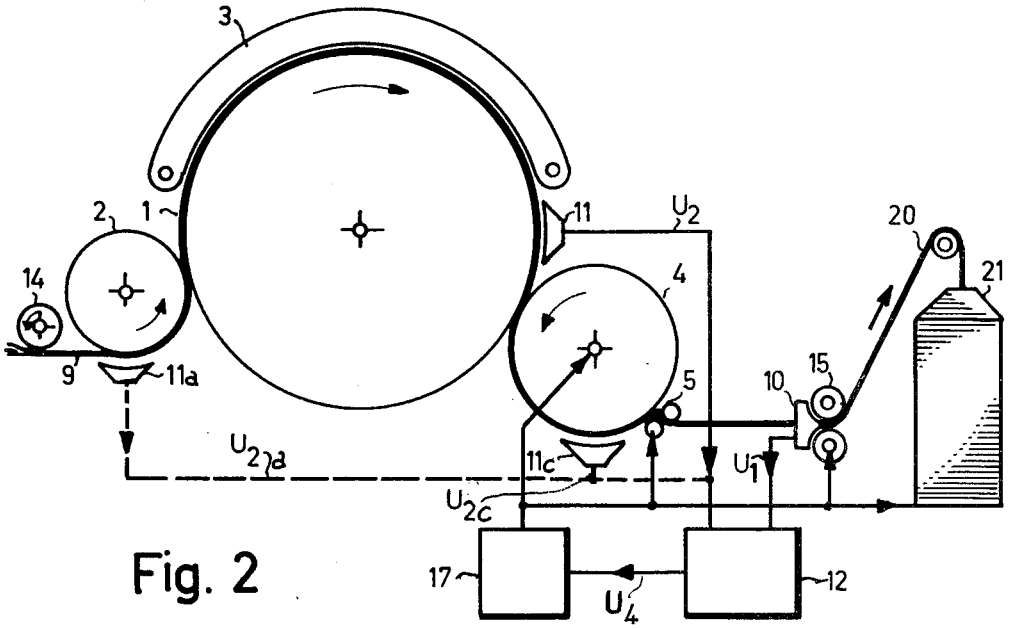
FIG. 2 illustrates a card with a second type of regulator in accordance with the present invention.

In the variation according to FIG. 2, the combined signal $U_4$ is fed to a regulating member 17 which is also controlled in its resultant speed, but controls the speed of the take-off calender 15, the take-off rollers 5, and the take-up device 21. Further, as a variation, the doffer 4 may also be controlled depending upon the magnitude of the combined signal $U_4$. The amount of fibre material taken off the cylinder 1 or doffer 4 is metered in such a way that the fibre sliver 20 has a count which is as uniform as possible.

In the variation according to FIG. 2, it is advantageous if a measuring member arrangement according to the variation shown with the sensor 11*c* is selected, and a signal $U_{2c}$ is produced instead of $U_{2b}$ so that the distance to the regulating position remains small.

Figure 3:
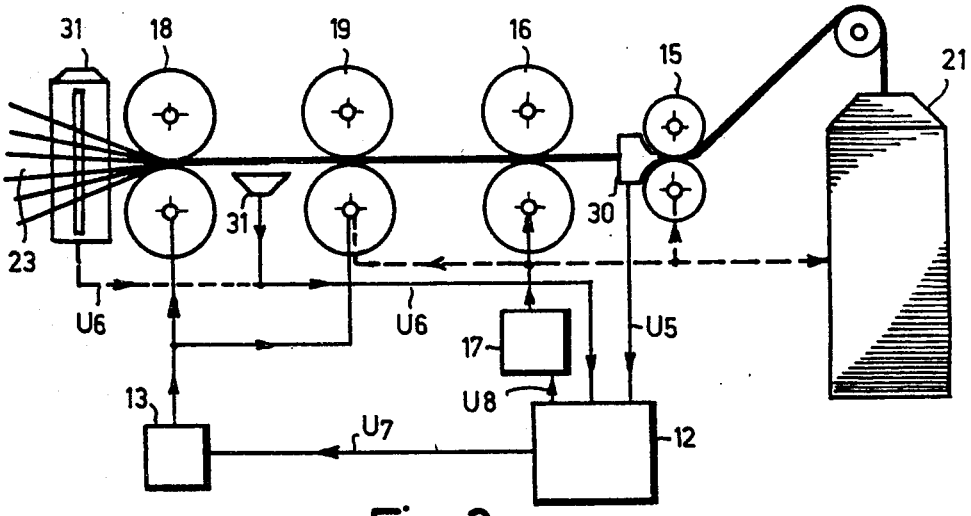
FIG. 3 illustrates a drafting mechanism with a regulator and preliminary control device in accordance with the present invention.

FIG. 3 shows the application of the method according to the invention and a corresponding device on a drafting mechanism. The drafting mechanism consists essentially, in a manner known per se, of three pairs of drafting rollers. This includes a pair of take-in rollers 18, a pair of cylinders 19 and a pair of cylinders 16. Preliminary drafting is adjusted between the pair of take-in cylinders 18 and the pair of cylinders 19 by selecting suitable speeds, and the main drafting is adjusted between the pair of cylinders 19 and the pair of cylinders 16.

A first measuring device 30 determines the cross-section of the issuing draft sliver 23 and emits a corresponding signal $U_5$. A second measuring device 31 or 31' is arranged upstream of the first measuring device 30, as close as possible to the regulating position, inside, upstream of or downstream of the drafting zone where it is possible to fit a measuring member, for example between the pair of take-in rollers 18 and the pair of rollers 19, or, when viewed in the direction of the entering card slivers 23, upstream of the pair of take-in rollers 18. The test signal $U_6$ of the second measuring device is fed with a test signal $U_5$ to the signal evaluating device 12 in the manner already described. The resulting combined signal $U_7$ or $U_8$ controls the speed of either the upstream pair of cylinders 16, or preferably, the pair of take-in rollers 18 and the downstream pair of cylinders 19. The main drafting can therefore be changed between the pairs of rollers 19 and 16. The device is advantageously arranged in such a way that the speed of the pair of rollers 16 is unchangeable. The yield of drafter silver 22 is therefore constant and the silver receiving device 21' can operate at a constant speed. In this case, the speed of the pair of take-in rollers 18 and the downstream pair of cylinders 19 can be influenced via the regulating member 13 by the combined signal $U_7$. It is also conceivable to regulate the preliminary drafting. In this case, the regulating member 13 influences only the speed of the pair of take-in rollers 18.

Complicated fitting conditions or other reasons may however make it necessary to regulate drafting by varying the delivery rate via a regulating member 17 and only the upstream pair of cylinders 16 is usually variable in speed. If preliminary drafting is regulated, the downstream pair of cylinders 19 can be driven with the same percentage of variation in speed.

When regulating drafting by varying the delivery rate, it is necessary to coordinate the fibre silver receiver 21 with the variable delivery of the drafter silver. However, it is also important here to form a combined signal $U_7$ or $U_8$ from the signals $U_5$ from a first measuring device 30 in the region of the silver delivery and the signals $U_6$ from a second upstream measuring device 31, as near as possible to the regulating position, so that both short and long variations in cross-section can be compensated.

When arranging the second measuring device 31 upstream of the regulating position, a delay line known per se and not therefore shown here is arranged between the measuring member 31 and the signal evaluator 12.

It is to be understood, of course, that the elements shown in block diagram form can relate to a variety of devices constructed in a known manner to perform the functions discussed herein. For example, various arrangements are well-known for combining a pair of input signals to form a particular output signal containing portions of the signal magnitudes of both input signals, as is done by the signal evaluator 12. This can include adding of dc levels if the input signals and output signal are all dc voltages, or other known arrangements for combining in the event that ac signals are involved. Similarly, although the regulator 13 has been discussed in terms of being a dc motor, it is, of course, understood that other known regulators could be used.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. A method of regulating out variations in the silver weight on a device for processing a fibre silver wherein said device has an inlet and an outlet for the fibre silver and silver processing cylinders, comprising:

making a first cross-sectional measurement of the fibre silver, and forming a first test signal corresponding to this first measurement;

making a second measurement of the relative variations in the cross-section of the fibre material which is located on said silver processing cylinders with respect to an average value for these variations formed over a predetermined period, and forming a second test signal corresponding to this second measurement, wherein said second measurement is made at a position adjacent to said silver processing cylinders and closer to the inlet of the device than the position where the first measurement is made; and controlling at least one regulating device which regulates the cross-section of the fibre silver in accordance with said first and second test signals.

2. A method according to claim 1, wherein the first measurement is a measurement of the absolute cross-section of the fibre silver.

3. A method according to claim 1, wherein the first measurement is a measurement of the relative variation of the cross-section of the fibre silver relative to a predetermined desired value of the fibre silver at the outlet of the device.

4. A method according to claims 1, 2, or 3, wherein the first and second test signals are superimposed on each other to form a combined signal for controlling said regulating device.

5. A method according to claim 4, wherein the regulating device which acts on the cross-section of the fibre silver is a feed roller, and the step of controlling comprises controlling the rotational speed of the feed roller.

6. A method according to claim 4, wherein the regulating device which acts on the cross-section of the fibre silver includes a take-off calender, a take-off roller and a take-up device, and the step of controlling comprises controlling the rotational speeds of these regulation elements in common for the fibre material delivered.

7. A method according to claims 1, 2, or 3, wherein the regulating device which acts on the cross-section of the fibre silver is a feed roller, and the step of controlling comprises controlling the rotational speed of the feed roller.

8. A method according to claim 7, wherein the second measurement is made at the feed roller.

9. A method according to claims 1, 2, or 3, wherein the regulating device which acts on the cross-section of the fibre sliver includes a take-off calender, a take-off roller and a take-up device, and the step of controlling comprises controlling the rotational speeds of these regulation elements in common for the fibre material delivered.

10. A method according to claim 9, further comprising regulating the rotational speed of a doffer simultaneously with the regulation of the take-off calender.

11. A method according to claim 10, wherein the second measurement is made at the doffer.

12. A method according to claim 1, wherein the second test signal controls a regulating device for issuing the fibre silver, and the first test signal regulates the rotational speed of a feed roller for the fibre material supplied.

13. A method according to claim 1, wherein the fibre material is in an opened form which is distributed over a predetermined width when the second measurement is made.

14. A method according to claim 1, wherein the first measurement is made at the outlet of the device.

15. A method according to claim 1, wherein the second measurement is made at the inlet of the device.

16. A method according to claim 1, wherein the device is a card.

17. A method according to claim 1, wherein the device is a draw frame.

18. A method according to claim 1, wherein the silver processing cylinders include a licker-in cylinder, a main cylinder and a doffer.

19. A method according to claim 18, wherein the second measurement is made adjacent said main cylinder.

20. A method according to claim 18, wherein the second measurement is made adjacent said licker-in cylinder.

21. A method according to claim 18, wherein the second measurement is made adjacent said doffer.

22. An apparatus for regulating out variations in the silver weight on a device for processing a fibre sliver, wherein said device has an inlet and an outlet for the fibre sliver and silver processing cylinders, comprising:

a first measuring device for making a first cross-sectional measurement of the fibre silver, and forming a first test signal corresponding to this first measurement;

a second measuring device located at a position adjacent to said silver processing cylinders and closer to the inlet of the device than said first measuring device for making a second measurement of the relative variations in the cross-section of the fibre material which is located on said silver processing cylinders relative to an average value of these variations formed over a predetermined period, and forming a second test signal corresponding to this second measurement; and a regulating device coupled to said first and second measuring devices for controlling the cross-section of the fibre silver in accordance with said first and second test signals.

23. An apparatus according to claim 22, wherein the first measurement is a measurement of the absolute cross-section of the fibre silver.

24. An apparatus according to claim 22, wherein the first measurement is a measurement of the relative variation of the cross-section of the fibre silver relative to a predetermined desired value of the fibre silver at the outlet of the device.

25. An apparatus according to claims 22, 23, or 24, further comprising a signal evaluating device in which the first and second test signals are superimposed to form a combined signal.

26. An apparatus according to claim 25, wherein the rotational speed of a feed roller for supplying the fibre material is responsive to the resulting combined signal.

27. An apparatus according to claim 25, wherein the second measurement device is located at the feed roller.

28. An apparatus according to claims 22, 23, or 24, further comprising a signal evaluating device in which the first and second test signals are superimposed to form a combined signal which is supplied to means controlling in common the rotational speed of a take-off calender, a take-off roller and a take-up device for the fibre material.

29. An apparatus according to claim 28, wherein the combined signal also controls the rotational speed of a doffer.

30. An apparatus according to claim 28, wherein the second measurement device is located at the doffer.

31. An apparatus according to claim 22, further comprising a regulating device coupled to the second test signal for controlling the cross-section of the fibre sliver, and means coupled to the first test signal for controlling the amount of fibre material fed to the machine.

32. An apparatus according to claim 22, wherein the second measuring device is located at a point of the device where the fibre material is spread out in finely divided form.

33. An apparatus according to claim 22, wherein the first measurement device is located at the outlet of the device.

34. An apparatus according to claim 22, wherein the second measurement device is located at the inlet of the device.

35. An apparatus according to claim 22, wherein the device for processing the fibre sliver is a card.

36. An apparatus according to claim 22, wherein the device for processing the fibre sliver is a draw frame.

37. An apparatus according to claim 22, wherein the sliver processing cylinders include a licker-in cylinder, a main cylinder and a doffer.

38. An apparatus according to claim 37, wherein the second measuring device is located adjacent said main cylinder.

39. An apparatus according to claim 37, wherein the second measuring device is located adjacent said licker-in cylinder.

40. An apparatus according to claim 37, wherein the second measuring device is located adjacent said doffer.

* * * * *

UNITED STATES PATENT AND TRADEMARK OFFICE

CERTIFICATE OF CORRECTION

PATENT NO. : 4,271,565

DATED : June 9, 1981

INVENTOR(S) : Werner GRUNDER

It is certified that error appears in the above-identified patent and that said Letters Patent are hereby corrected as shown below:

Column 5, lines 1, 17, 18, 21, 55, 56, 57, 58, 60, and 64:

Change "silver" to --sliver--.

Column 6, lines 2, 6, 10, 13, 14, 22, 26, 32, 51, and 66:

Change "silver" to --sliver--.

Column 7, lines 10, 12, 14, 18, 22, 29, 33, 36, and 37:

Change "silver" to --sliver--.

Signed and Sealed this

Third Day of May 1983

[SEAL]

*Attest:*

GERALD J. MOSSINGHOFF

*Attesting Officer*

*Commissioner of Patents and Trademarks*